US006675783B1

(12) United States Patent
Kawamura et al.

(10) Patent No.: US 6,675,783 B1
(45) Date of Patent: Jan. 13, 2004

(54) CONTROL DEVICE OF EXHAUST RECIRCULATION VALVE

(75) Inventors: Satoshi Kawamura, Tokyo (JP); Sotsuo Miyoshi, Tokyo (JP); Toshihiko Miyake, Tokyo (JP); Youichi Fujita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/110,377

(22) PCT Filed: Aug. 14, 2000

(86) PCT No.: PCT/JP00/05444

§ 371 (c)(1),
(2), (4) Date: Apr. 11, 2002

(87) PCT Pub. No.: WO02/14674

PCT Pub. Date: Feb. 21, 2002

(51) Int. Cl.[7] ..... F02M 25/07
(52) U.S. Cl. ..... 123/568.23; 251/129.11

(58) Field of Search ..... 123/568.23, 568.24, 123/568.21, 568.16, 568.26, 568.19; 251/129.11

(56) References Cited

U.S. PATENT DOCUMENTS

| | | | | | |
|---|---|---|---|---|---|
| 6,012,437 | A | * | 1/2000 | Radhamohan et al. . | 123/568.23 |
| 6,182,645 | B1 | * | 2/2001 | Tsuchiya ..... | 123/568.23 |
| 6,382,194 | B2 | * | 5/2002 | Maeda ..... | 123/568.16 |
| 6,546,920 | B1 | * | 4/2003 | Kawamura et al. .... | 123/568.23 |

FOREIGN PATENT DOCUMENTS

| | | | | |
|---|---|---|---|---|
| EP | 1310661 | A1 * | 5/2003 | ..... F02M/25/07 |
| JP | 7-119818 | | 5/1995 | |
| JP | 10-122059 | | 5/1998 | |

* cited by examiner

*Primary Examiner*—Henry C. Yuen
*Assistant Examiner*—Hyder Ali
(74) *Attorney, Agent, or Firm*—Sughrue Mion, PLLC

(57) ABSTRACT

A DC motor for driving an exhaust gas-recirculation valve provided in an exhaust gas recirculation system is controlled by an analog circuit to thereby simplify the circuit configuration and improve the security against a high temperature.

6 Claims, 8 Drawing Sheets

CONTROL DEVICE OF EXHAUST RECIRCULATION VALVE

TECHNICAL FIELD

This invention relates to an apparatus for controlling an exhaust gas recirculation valve (hereinafter referred to as an EGR valve) which is disposed in an exhaust gas recirculation system.

BACKGROUND ART

FIG. 1 is a conventional schematic explanation diagram of an engine exhaust system.

In this apparatus for controlling the EGR valve, the opening and closing of the control valve 11 is controlled by, for example, a stepping motor M of a hybrid PM type 4-phase construction or the like. An open-loop control of the stepping motor M by a stepping angle contributes to a control over the degree of the opening of the control valve 11.

Such a control apparatus using this kind of stepping motor M imposes a restriction on the control over the degree of the control of the control valve 11 because the degree of the opening of the control valve 11 can be controlled only by the stepping angle of the stepping motor M, the control valve 11 has a limited resolution of the controllable opening. In addition, the stepping motor M has a limited open-loop control response characteristic due to the possible occurrence of a stepping-out phenomenon. Once the stepping-out phenomenon has occurred, the reliability falls as an error is still contained uncompensated in the control amount.

To this end, the conventional apparatus for controlling an EGR valve gives a predetermined return torque to the control valve 11 in the opening or closing direction by urging means and, by the application of a unidirectional current to a direct current (DC) motor (hereinafter referred to also as a DC motor) gives a motor torque to vary the control valve 11 in the closing direction, and opens and closes the control valve 11 by the balance of these torque. An arrangement is described in Japanese Published Unexamined Patent Application No. 122059/1998. This arrangement includes an open loop control system for controlling an open loop of the DC motor such that a motor torque is generated in corresponding with a target opening and closing positions of the above control valve 11; and a feedback control system for feedback-controlling the DC motor based on a deviation between input data corresponding to the target opening and closing positions of the control valve 11 and detected data of the current opening and closing positions of the control valve 11.

FIG. 2 is a characteristic diagram showing the relationship between a motor torque and an opening and closing position of a control valve in an EGR valve of torque balance drive system.

First, the driving system using this DC motor will be described. In case the degree of the opening of the control valve 11 is feedback-controlled in a DC servo motor system, the generated torque of the DC motor is continuously controlled by feeding back the degree of the opening of the control valve 11 through unintermitted detection with a position sensor such as a sliding resistor type. Theoretically, the continuos control over the generated torque of the motor M promotes infinite reduction of the resolution. Further, the DC motor does not cause the control error due to the stepping-out as with the stepping motor M and, therefore, the response can be improved accordingly as compared with the case where the stepping motor M is used, thereby improving reliability.

This kind of apparatus for controlling the EGR valve using the DC motor adopted a so-called torque balance system. The apparatus gives a predetermined return torque in the closing direction (or in the opening direction) by means of a spring as urging means, gives a variable motor torque in the opening direction (or in the closing direction) by unidirectional power feeding to the DC motor and controls the valve opening and closing by the balance of these torque.

In case this kind of driving system is adopted, since the EGR valve is constantly given the return torque, there occurs a hysteresis, due to friction, as shown in FIG. 2 between the operating characteristic A when the control valve 11 is opened by increasing the motor torque and the operating characteristic B when the control valve 11 is closed by decreasing the motor torque. The inclination of the operating characteristics A, B varies depending on the spring constant of the spring which gives the return torque, and the operating characteristics A, B shift to the right or to the left in FIG. 2 depending on the magnitude of the set torque.

Now, in order to control the control valve 11 having this kind of operating characteristics, suppose that a method is admitted, in which the DC motor is under the control of a PI (proportional) I (integral) control based on a deviation between the input data corresponding to the target opening and closing position of the control valve 11 and the detected data of the current opening and closing position of the control valve. In this case, owing to the relation of the operating characteristics as shown in FIG. 2, it becomes difficult to stabilize the control valve 11 in the target opening position.

In other words, in order to open the control valve 11 to the target opening position by increasing the motor torque, the P gain and the I gain must be increased to take the control along the operating characteristic A in FIG. 2. However, when the motor torque is increased under the control of this kind, the deviation of the opening position of the control valve 11 becomes "0" as soon as the control valve 11 is opened to the target opening position. The P component thus becomes "0" and the I component is cleared, with the result that the control valve 11 begins to close by the return torque.

FIG. 3 is a characteristic diagram showing the relationship between the time and the opening and closing position in the EGR valve.

At an initial stage, the control valve 11 begins to close (at the time the deviation is small), since the P and I components are both small, the motor torque cannot overwhelm the return torque, with the result that the deviation becomes large. Thereafter, even if the deviation becomes large to a certain degree, the motor torque and the return torque balance with each other, and therefore the closing operation of the control valve 11 cannot stop abruptly due to the inertia of the DC motor M. The control valve 11 thus cannot be operated in the opening direction immediately. If the gain is made large such that generate a relatively large motor torque is generated even when the deviation is small, there will be a vicious cycle that incurs an increase of the overshooting and undershooting as shown in FIG. 3.

FIG. 4 is longitudinal sectional view of the RGR valve.

An apparatus for controlling the control valve 11 in a so-called torque balance drive system using the DC motor M will be made in consideration of the above situation with reference to FIGS. 4 to 7.

Referring to FIG. 4, reference numeral 1 denotes a valve body having formed therein a passage which forms a part of an exhaust gas recirculation passage c interposed in a recirculation system of the exhaust gas. By moving upwardly the control valve 11 as illustrated to contact a valve seat 12, the exhaust gas recirculation passage c is closed and, by moving downwardly the control valve 11 to apart from the valve seat 12, the exhaust gas recirculation passage c is opened.

Reference numeral 2 denotes a motor case for housing therein a DC motor 20. In the DC motor 20, reference numeral 21 denotes a rotor around which a coil 22 is wound, and reference numeral 23 denotes a yoke provided with a magnet 24. The upper end of the rotor 21 is rotatably supported on the motor case 2 by a sliding-ball 25 and a rotor shaft 26, and the lower end of the rotor 21 is rotatably supported on the valve body 1 by a bearing 27. A commutator 28 is attached to the upper end of the rotor 21, and a motor brush 30 provided on the motor case 2 is urged by a brush spring 29 into contact with the commutator 28.

Reference numeral 40 denotes a position sensor for detecting the rotational position of the rotor 21, and the position sensor is so arranged that its resistance value changes deepening on the rotational position of the rotor 21. This position sensor 40 and the motor brush 30 are connected by a connector terminal 3 to the control apparatus which will be described hereinafter.

Inside the rotor 21, a motor shaft 31 is screwed. The rotation of the motor shaft 31 is prohibited by a guide bush 13 provided on the body 1. It therefore follows that the motor shaft 31 moves upward and downward depending on the amount of rotation of the rotor 21. A valve shaft 14 is provided in contact with the lower end of the motor shaft 31, and an intermediate portion of the valve shaft 14 is guided by a guide seal 15 and a guide plate 16 so as to be movable upward and downward. The control valve 11 is attached to the lower end of the valve shaft 14.

Reference numeral 17 denotes a guide seal cover. Between a spring sheet 18 mounted on the upper end of the valve shaft 14 and the guide plate 16, a spring 19 is interposed for urging the valve shaft 14 in an upward direction, i.e., in the closing direction of the control valve 11.

The control valve 11 thus constituted in this manner is driven by a torque balance system as described above. In other words, the EGR valve gives a predetermined return torque in the closing direction of the control valve 11 by the spring 19 as the urging means, and also gives a variable motor torque in the opening direction of the control valve 11 by the unidirectional power feeding to the DC motor 20. By the balance of these torque, the control valve 11 is opened and closed.

FIG. 5 is a schematic diagram showing an engine control apparatus (referred to as ECU) 100 in the so-called torque balance device system using a DC motor. The motor driving voltage is determined by a control part 50 employing a microcomputer.

Referring to FIG. 5, reference numeral 52 denotes a battery. Reference numeral 53 denotes a motor driving voltage converting part for converting the output of the control part 50 and for supplying the converted output to the DC motor 20. The motor driving voltage converting part comprises a Zener diode 53*a*; a diode 53*b* for supplying the unidirectional current flow to the DC motor 20; a field-effect transistor (FET) 53*c*; and an interface 53*d* provided between the control part 50 and the FET 53*c*. Reference numeral 56 denotes a regulator to generate a driving voltage (5V) of the control part 50.

The control part 50 receives, through interfaces 58, 59, respectively, a detected signal from an operating state amount sensor 57 mounted on each part of the vehicle such as a crank angle sensor or the like, as well as that from the position sensor 40. The position sensor 40 in this example is provided with a movable contact part 42 for moving on a resistor 41 to which a constant voltage (5V) is applied from a voltage supply part 60. By the movement of the movable contact part 42 accompanying with the rotation of the rotor 21, a voltage corresponding to the rotating position of the rotor shaft 31 is outputted, as a detected signal, from the movable contact part 42.

Further, the above motor driving voltage converting part 53 switches on and off the voltage to be applied to the DC motor 20 at a constant period. The FET 53*c* is switched on and off by a pulse-width modulation (PWM) signal depending on the ratio of the on-time and the off-time per a period (driving duty), so that an average driving voltage to be applied to the DC motor 20 is controlled.

Since the above control part 50 controls the entire engine, the control of the DC motor 20 will be made during the intervals of the engine control, with the result that the optimum control is difficult. As a solution, an exclusive control circuit for the EGR valve is necessitated. This exclusive control circuit must be integrally assembled into the EGR valve. It follows that, if the control circuit is configured by a digital circuit using a microcomputer, the control circuit cannot be assembled into the EGR valve which reaches a temperature of 100 Ec or more because the microcomputer has a low heat-resistant temperature. In addition, the digital circuit has a complicated and costly circuit configuration.

This invention has been made to solve the above and other problems and has an object thereof is to provide such an exclusive control circuit for the EGR valve consisting of an analog circuit, which is able to resist to a high temperature, and has a simple and inexpensive circuit configuration.

DISCLOSURE OF INVENTION

An apparatus for controlling an exhaust gas recirculation (EGR) valve according to the invention comprises a computing circuit for outputting a control signal based on a target value signal indicative of the degree of a valve opening given from the outside and a current position signal of the valve; a voltage-duty converting circuit for changing the duty of the output signal based on the control signal; and a motor driving circuit for driving a DC motor by the output signal of the voltage-duty converting circuit.

Therefore, since such a circuit part of a lower heat-resistant temperature as a microcomputer is not used, the control apparatus can be integrally assembled directly into the EGR valve. In addition, since the control apparatus is constituted by analog circuits, the apparatus has a simple and inexpensive circuit configuration.

In the apparatus for controlling an EGR valve according to this invention a driving force in a normally-valve-open direction is given to a motor shaft of the motor with a force smaller than an urging force of a return spring so as to hold the motor shaft and a valve shaft in contact with each other.

Therefore, by the urging force of the return spring, the control valve can surely be held in the valve-closed state and also, when the control valve is opened, the control valve can be opened as soon as the DC motor is started.

In the apparatus for controlling an EGR valve according to this invention the maximum output voltage of the computing circuit and a 100% duty input voltage of the voltage-duty converting circuit coincide with each other.

Therefore, it is possible to improve the response characteristic.

In the apparatus for controlling an EGR valve according to this invention the computing circuit is provided with a negative hysteresis generating circuit.

Therefore, it is possible to reduce the hysteresis attributable to the urging force of the return spring by the output of the control circuit, with the result that the control valve is controllable with a higher accuracy and a good response characteristic.

In the apparatus for controlling an EGR valve according to this invention the negative hysteresis generating circuit is configured by at least one or more Zener diodes.

Therefore, it is possible to provide the negative hysteresis generating circuit having a simple configuration.

In the apparatus for controlling an EGR valve according to this invention the negative hysteresis generating circuit is configured by one or more diodes, or a combination of the one or more diodes and a resistor.

Therefore, it is possible to provide the negative hysteresis generating circuit of a simple configuration.

BEST MODE FOR CARRYING OUT THE INVENTION

In order to describe this invention in more detail, the best mode for carrying out this invention will be described hereinbelow with reference to the accompanying drawings.

EMBODIMENT 1

FIRST EMBODIMENT

Figure 6:
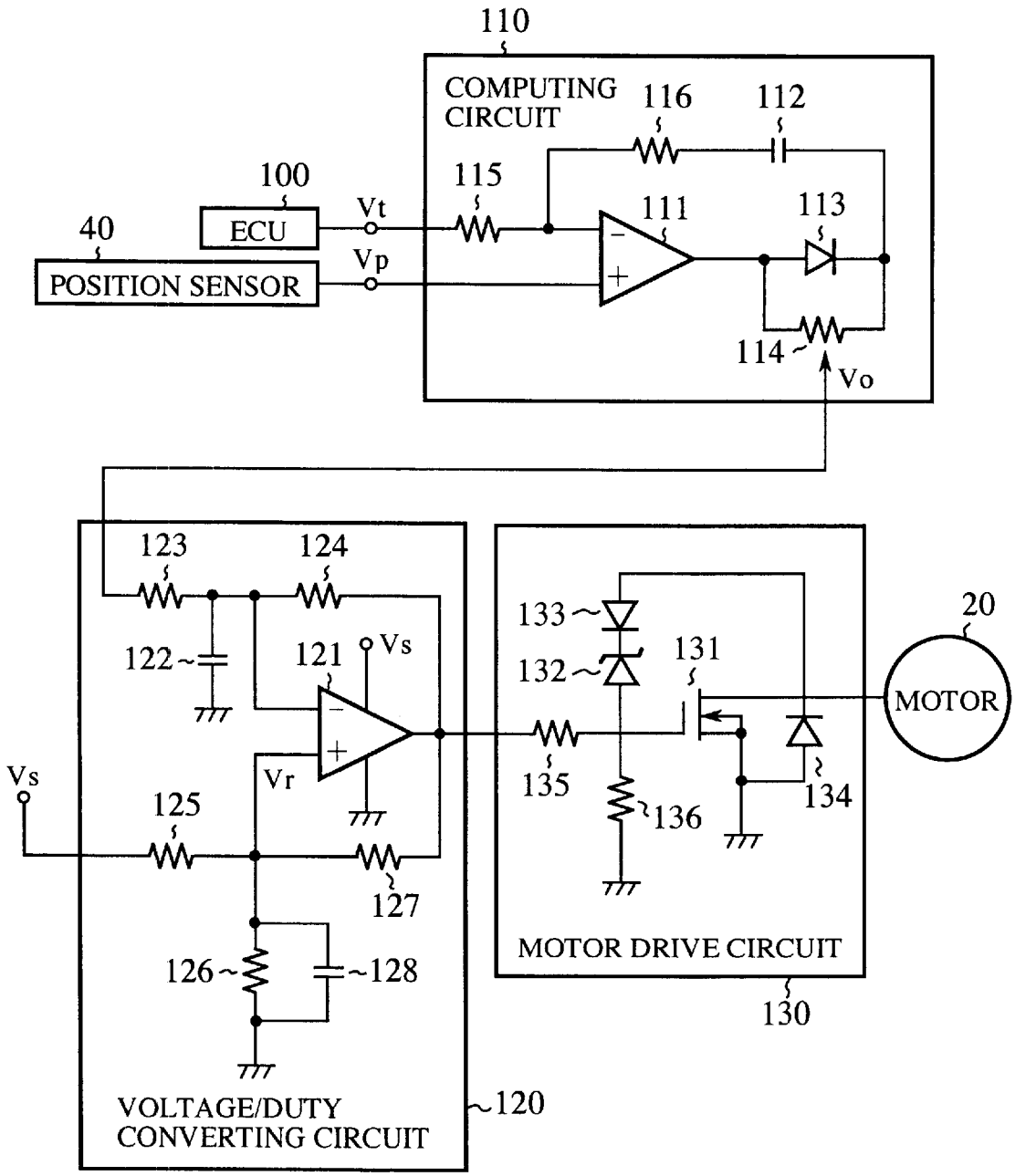
FIG. 6 is a circuit diagram showing a control apparatus for controlling an RGR valve according to a first embodiment.

FIG. 6 is a circuit diagram showing a control apparatus for controlling an EGR valve according to the first embodiment.

Referring to FIG. 6, reference numeral 110 denotes a computing circuit which receives a target value signal indicative of the degree of a valve opening given by an external ECU 100, and a current-position signal of the valve from a position sensor 40 inside the EGR valve. The control apparatus comprises a comparator 111, a capacitor 112, a diode 113, a variable resistor 114, and resistors 115, 116. Reference numeral 120 denotes a voltage-duty converting circuit for changing the duty of the output signal based on a control signal from the computing circuit 110, and which comprises an operational amplifier 121, capacitors 122, 128, and resistors 123 to 127. Reference numeral 130 denotes a motor driving circuit for driving the DC motor 20 by the output signal of the voltage-duty converting circuit 120, and which comprises a switching element 131, a Zener diode 132, diodes 133, 134, and resistors 135, 136.

The operation of the first embodiment will now be described.

Figure 1:
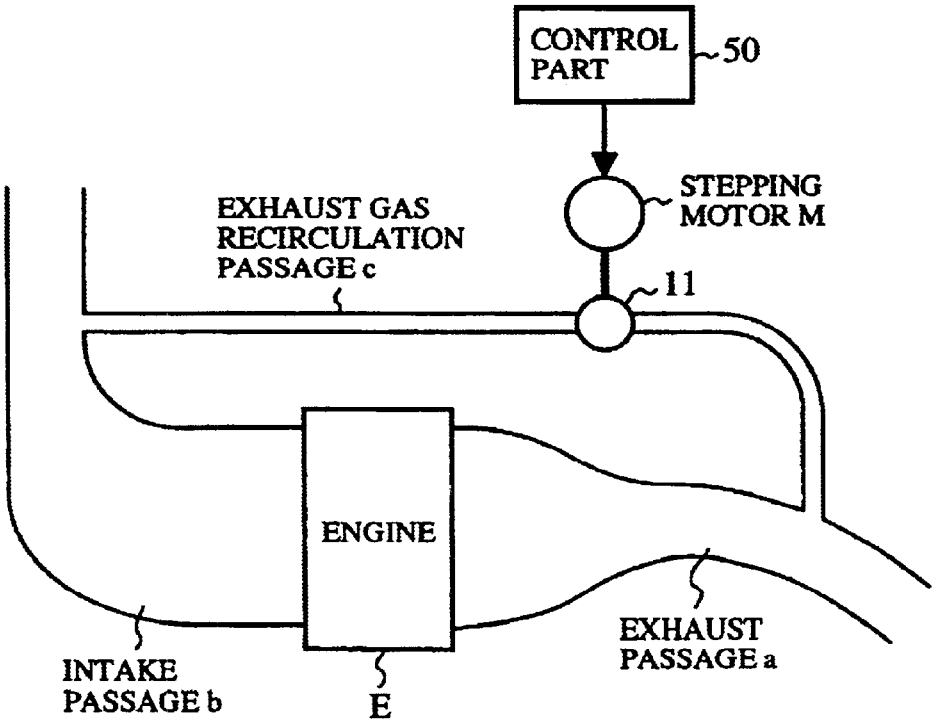
PRIOR ART FIG.1
FIG. 1 is a conventional schematic explanation diagram of an engine exhaust system.
Figure 2:
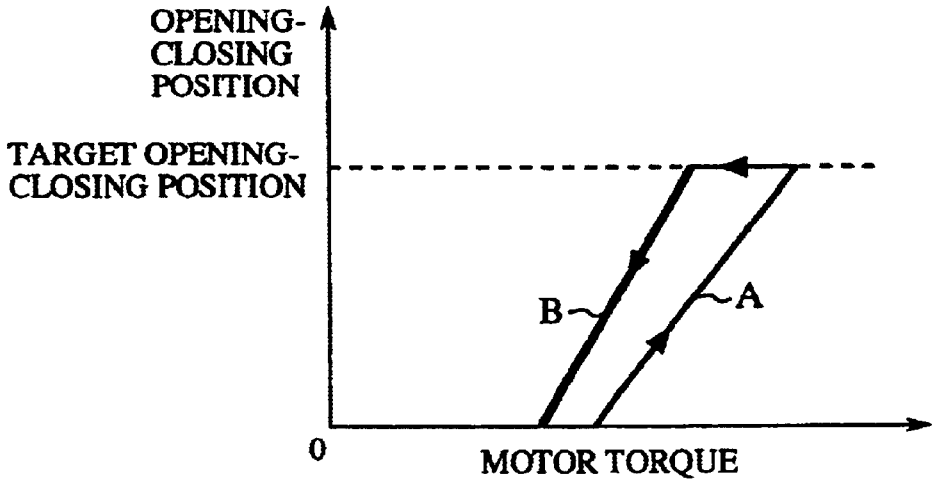
PRIOR ART FIG.2
FIG. 2 is a characteristic diagram showing the relationship between a motor torque and an opening and closing position of a control valve in an EGR valve of torque balance drive system.
Figure 3:
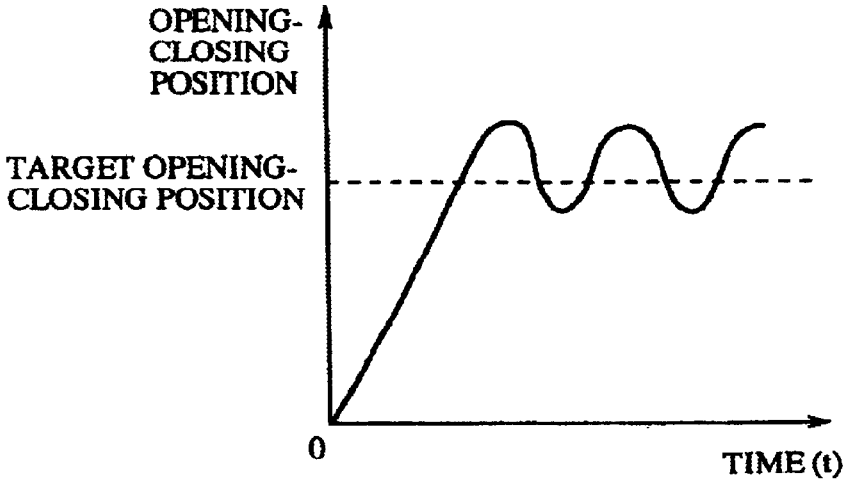
PRIOR ART FIG.3
FIG. 3 is a characteristic diagram showing the relationship between the time and the opening and closing position in the EGR valve.
Figure 4:
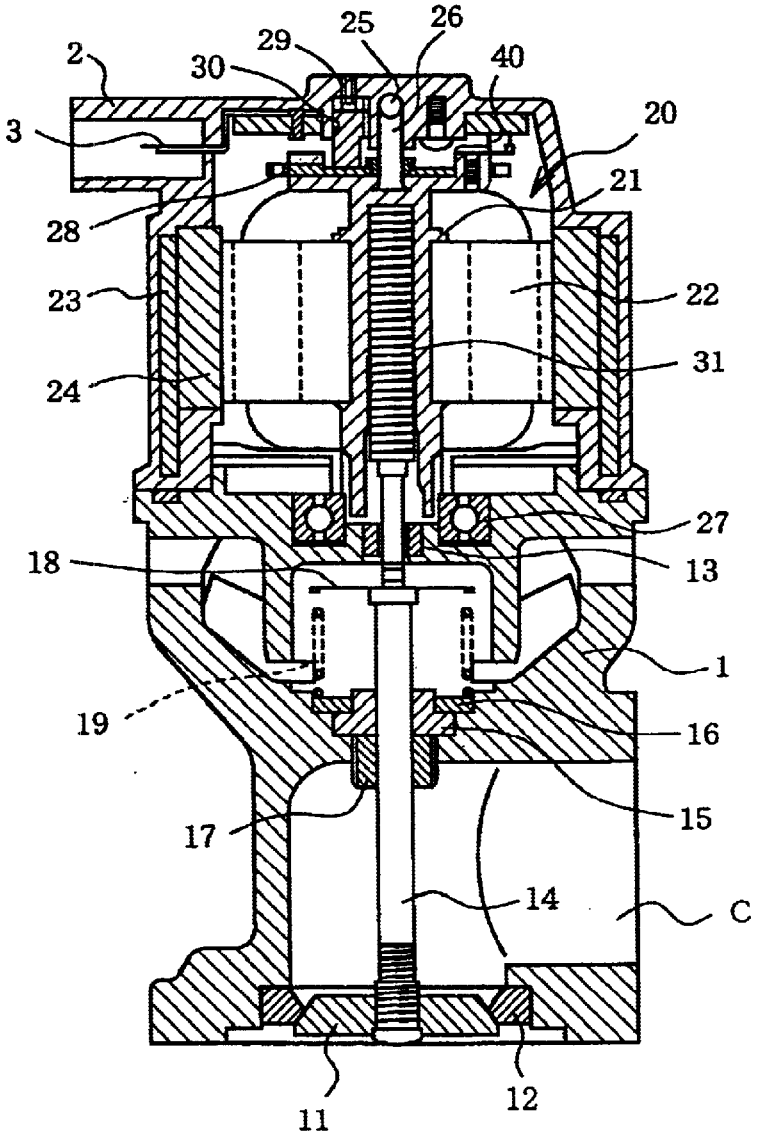
PRIOR ART FIG.4
FIG. 4 is a longitudinal sectional view of the EGR valve.
Figure 5:
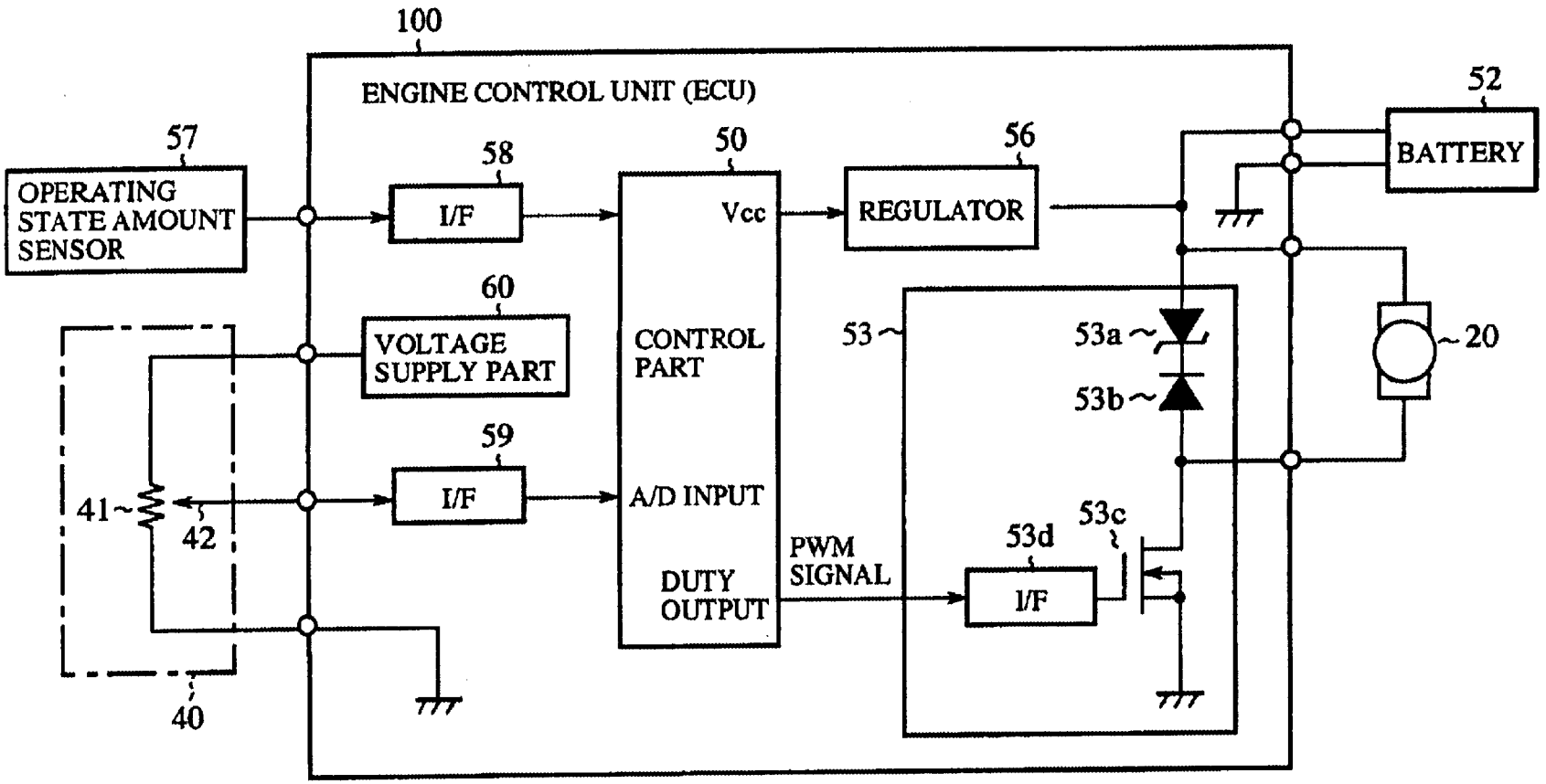
PRIOR ART FIG.5
FIG. 5 is a schematic diagram of a control apparatus in the so-called torque balance drive system using a DC motor.

The computing circuit 110 receives a target value signal Vt indicative of the degree of the valve opening from the ECU 100, and a current-position signal Vp of the valve from the position sensor 40 inside the EGR valve as shown in FIG. 4. Now, let the resistance value of the resistor 115 be Ri, the resistance value of the resistor 116 be Rf, and the capacitance value of the capacitor 112 be Cf, and suppose that the current flows in the direction of an arrow. Then, the output voltage Vo can be obtained by the following formula.

$$i=(Vt-Vp)/Ri$$

$$Vo=Vp-RfAi-(1/Cf)IiAdt$$

Hence $$Vo=Vp-Rf(Vt-Vp)-(1/CfARi)I(Vt-Vp)Adt$$

The output Vo is inputted to the voltage-duty converting circuit 120.

In this voltage-duty converting circuit 120, let the resistance value of the resistor 123 be Rta, the capacitance value of the capacitor 122 be Ct, the resistance value of the resistor 124 be Rtb, the resistance value of the resistor 125 be Rr2, the resistance value of the resistor 126 be Rr1, the resistance value of the resistor 127 be Rra, the capacitance value of the capacitor 128 be Cn, and the output value of the voltage-duty converting circuit 120 be Vd, respectively.

Figure 7:
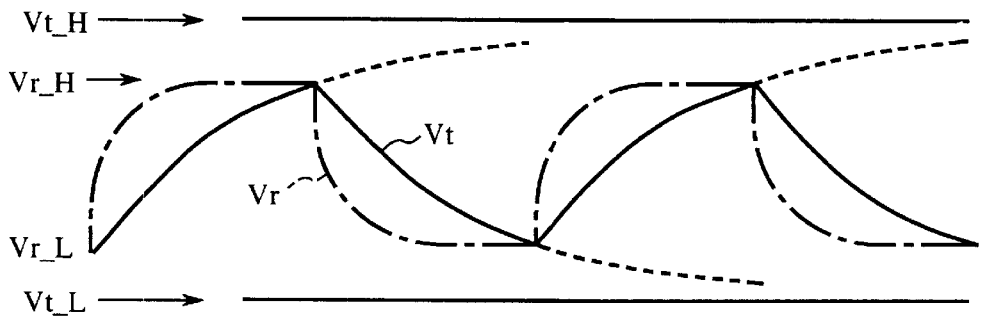
FIG. 7 is an explanation diagram of an operation of a voltage-duty converting circuit.

Further, in FIG. 7, let the target charging voltage of the capacitor 122 at a high output Vd be Vt–H, the target discharging voltage at a low output Vd be Vt–L, the input voltage value Vr at the high output Vd be Vr–H, and the input voltage value Vr at the low output Vd be Vr–L, respectively. Now, the operation will be described when the above conditions are set.

(a) Vd=High

The capacitance value Cn of the capacitor 128 is previously set so that the input voltage value Vr reaches Vr–H relatively quickly as compared with Vt. The target value signal Vt of the degree of the valve opening boosts with a lag relative to the input voltage value Vr. Then, if Vt–H>Vr–H, Vt will soon catch up with Vr and Vd will turn to low in the next instance.

(b) Vd=Low

The capacitance value Cn of the capacitor 128 is previously set so that the input voltage value Vr reaches Vr–L relatively quickly as compared with Vt. The target value signal Vt of the degree of the valve opening lowers with a lag relative to the input voltage value Vr. Then, if Vt–H<Vr–H, Vt will soon catch up with Vr and will turn to high in the next instance.

By repeating the above operations (a), (b), an oscillation is taken place as shown in FIG. 7.

This oscillation output is supplied to the motor driving circuit 130 to switch on and off the switching element 131, thereby operating the DC motor 20. Owing to the operation of this DC motor 20, the motor shaft 31 moves as described with reference to FIG. 4, which presses the valve shaft 14 to open the valve 11.

Calculation of each voltage and conditions of resistance values (1) Voltage at Each Part Let the high level of the output voltage Vd of the OP amplifier 121 be Vh and the low level thereof be Vl. Further, let the power line voltage be Vs and, by using the resistance value of each of the resistors in the above voltage-duty converting circuit 120, the following formulas are obtained.

$$Vp=VsARr1/(Rr1+Rr2)$$

$$Rrb=Rr1ARr2/(Rr1+Rr2)$$

Then, we have $$Vt-H=(RtbAVo+RtaAVh)/(Rta+Rtb)$$

$$Vt-L=(RtbAVo+RtaAVl)/(Rta+Rtb)$$

$$Vr-H=(RraAVp+RrbAVh)/(Rra+Rrb)$$

$$Vr-L=(RraAvp+RrbAvl)/(Rra+Rrb)$$

(2) Conditions of Resistor Values

In order to render the duty 100% when the input voltage (output voltage of the computing circuit 110) Vo is at a low level Vl, the following is applied.

$$Vt-H\ (Vc=Vl)=Vr-H-\alpha(RtbAVl+RtaAVh)/(Rta+Rtb)\ =(RraAvp+RrbAvh)/(Rra+Rrb)-\alpha$$

In order to render the duty very small when the output voltage Vo is at a high level Vh, the following formula is applied.

$$Vt-L\ (Vc=Vh)=Vr-L-\alpha(RtbAvh+RtaAvl)/(Rta+Rtb)\ =(RraAVp+RrbAVl)/(Rra+Rrb)-\alpha$$

where $\alpha$ is a voltage value which slightly exceeds the 100% duty.

On the other hand, if there is no more target value signal supplied indicative of the degree of the valve opening from the ECU 100, the output voltage Vo in the computing circuit 110 decreases and, as a result, the duty ratio to be outputted from the voltage-duty converting circuit 120 also becomes small. In addition, the power feeding amount applied to the DC motor 20 decreases, and the DC motor 20 is thus driven by a driving force which is smaller than the urging force of the return spring. Therefore, the valve shaft 14 moves in the direction opposite to that as described above, while pushing a motor shaft 31, to move the motor shaft 31 by the urging force of the return spring. This the control valve 11 comes into contact with the valve seat 12 to close the passage c.

SECOND EMBODIMENT

Figure 8:
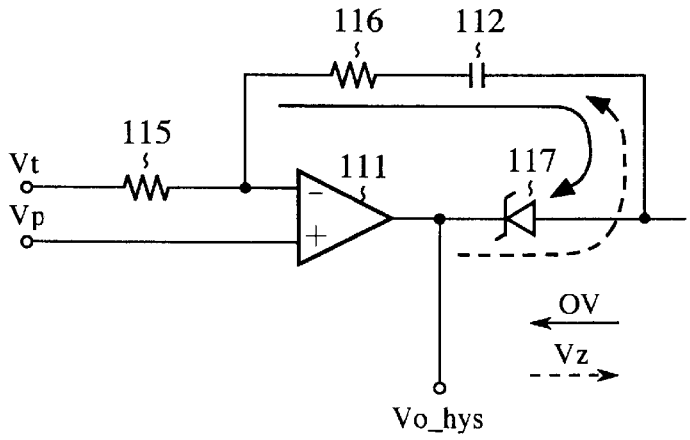
FIG. 8 is a circuit diagram having built a negative hysteresis generating circuit into a computing circuit in the control apparatus according to a second embodiment.

FIG. 8 is a circuit diagram having built a negative hysteresis generating circuit into a computing circuit in the control apparatus according to a second embodiment.

Instead of the diode 113 and the resistor 114 on the output side of the comparator 111 in the computing circuit 110 in FIG. 6 of the above first embodiment, a Zener diode 117 is provided as a negative hysteresis generating circuit.

The operation of the second embodiment will now be described.

(a) Vt>Vp

In this case, the current flows through the circuit in the direction of a solid-line arrow. At this time, since the voltage to be generated in the Zener diode 117 becomes "0", thus $$Vo-hys=Vo$$

(b) Vt<Vp

In this case, the current flows through the circuit in the direction of a dotted-line arrow. At this time, since the voltage to be generated in the Zener diode 117 becomes "Vz", thus $$Vo-hys=Vo+Vz$$

As a result, it is possible to generate the negative hysteresis characteristics.

Figure 9:
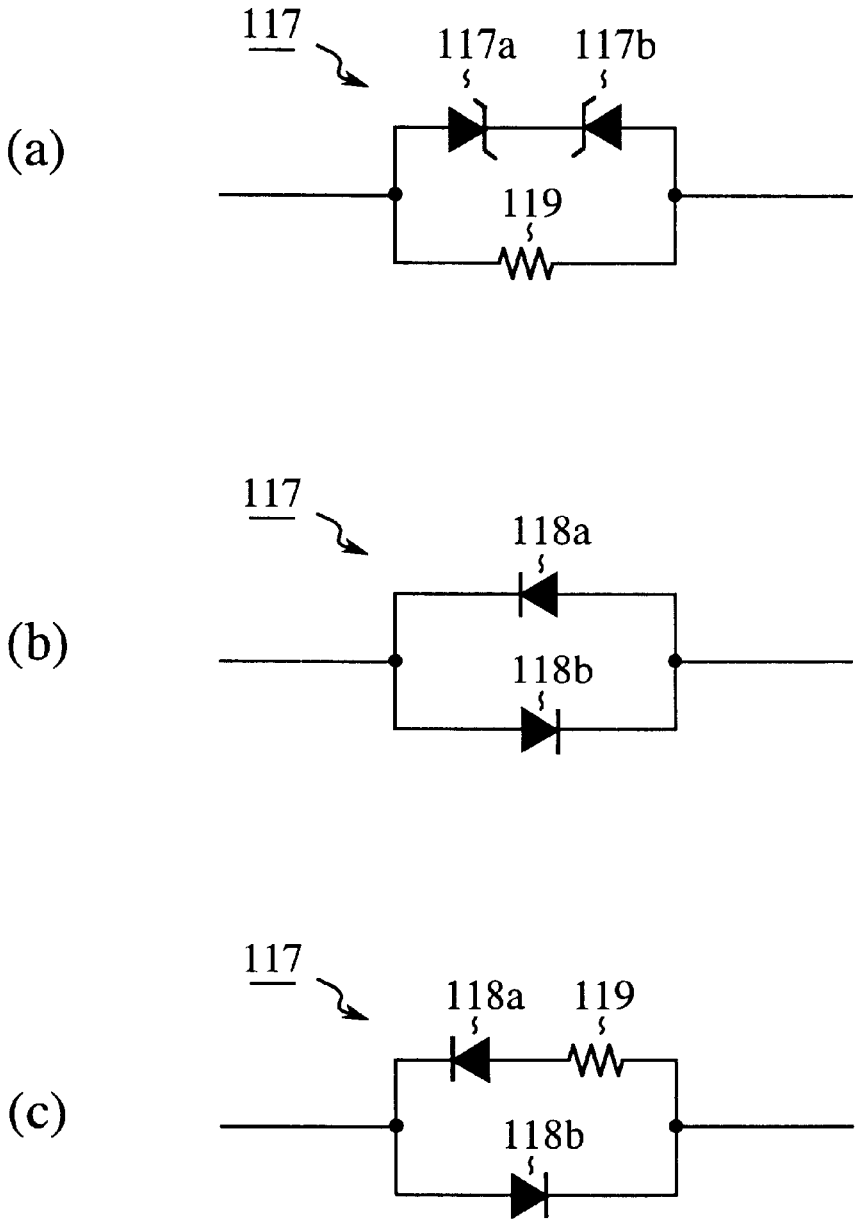
FIGS. 9A to 9C are various negative hysteresis generating circuit diagrams.

As the circuit for generating the negative hysteresis, any one of the following circuit configurations may be taken, i.e., a circuit as shown in FIG. 9A in which a resistor 119 is connected in parallel with Zener diodes 117*a*, 117*b* connected in series; a circuit as shown in FIG. 9B in which diodes 118*a*, 118*b* are in reverse-parallel connection with each other; and a circuit as shown in FIG. 9C in which a diode 118*b* is connected in parallel with a diode 118*a* and a resistor 119 connected in series.

The hysteresis correction will be described.

Figure 10:
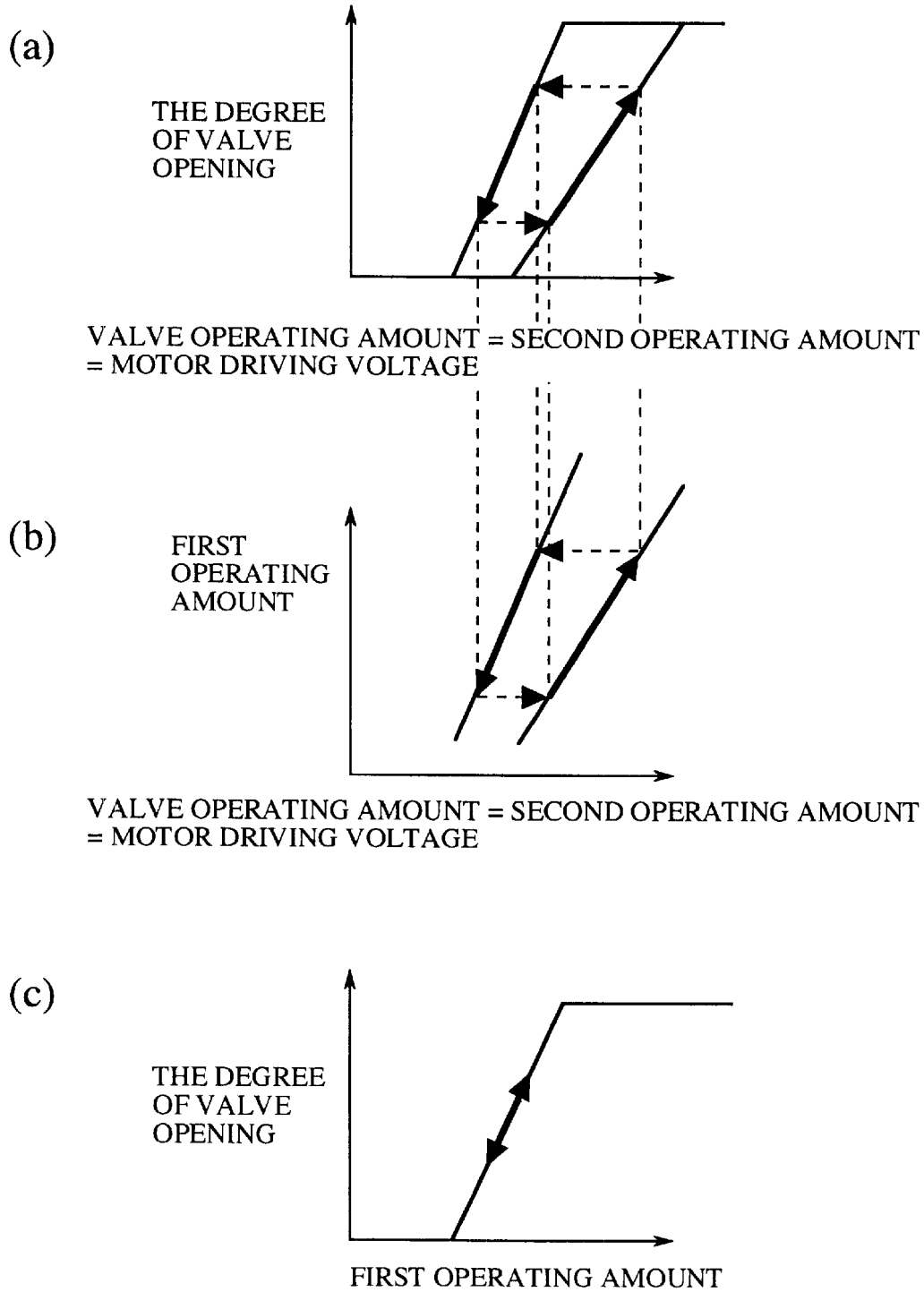
FIGS. 10A to 10C are explanation diagrams of the reduction in hysteresis by a negative hysteresis.

The ordinary positive hysteresis (motor driving voltage= second operating amount) versus the degree of the valve opening as shown in FIG. 10A shows the characteristics against those of the negative hysteresis (first operating amount=valve operating amount) versus the second operating amount=motor driving voltage as shown in FIG. 10B.

Therefore, if the DC motor 20 which is the driving motor of the EGR valve having the positive hysteresis characteristics as shown in FIG. 10A is controlled by the output of the analog control circuit having the negative hysteresis characteristics as shown in FIG. 10B, the positive hysteresis characteristics and the negative hysteresis characteristics cancel each other. As a result, as shown in FIG. 10C, the hysteresis is reduced in the characteristics of the second operating amount (=motor driving voltage) versus the degree of the valve opening.

INDUSTRIAL APPLICABILITY

As mentioned above, the apparatus for controlling the EGR valve according to the invention is qualified for returning a part of the exhaust gas of the exhaust passage "a" to the intake passage b in quickly response to the change in the engine operating conditions.

What is claimed is:

1. An apparatus for controlling an exhaust gas recirculation (EGR) valve comprising:

a computing circuit for outputting a control signal based on a target value signal indicative of the degree of a valve opening given from the outside and a current position signal of the valve;

a voltage-duty converting circuit for changing the duty of the output signal based on the control signal; and a motor driving circuit for driving a DC motor by the output signal of said voltage-duty converting-circuit.

2. The apparatus for controlling an EGR valve according to claim 1, wherein a driving force in a normally-valve-open direction is given to a motor shaft of said motor with a force smaller than- an urging force of a return spring so as to hold said motor shaft and a valve shaft in contact with each other.

3. The apparatus for controlling an EGR valve according to claim 1, wherein the maximum output voltage of said computing circuit and a 100% duty input voltage of said voltage-duty converting circuit coincide with each other.

4. The apparatus for controlling an EGR valve according to claim 1, wherein said computing circuit is provided with a negative hysteresis generating circuit.

5. The apparatus for controlling an EGR valve according to claim 4, wherein said negative hysteresis generating circuit is configured by at least one or more Zener diodes.

6. The apparatus for controlling an EGR valve according to claim 4, wherein said negative hysteresis generating circuit is configured by one or more diodes, and a combination of said one or more diodes and a resistor.

* * * * *